US012790829B2

(12) United States Patent
Merrick et al.

(10) Patent No.: US 12,790,829 B2
(45) Date of Patent: Nov. 10, 2026

(54) FLAT SIDING PRODUCT WITH LOCKING SPLINE

(71) Applicant: LOUISIANA-PACIFIC CORPORATION, Nashville, TN (US)

(72) Inventors: Gareth Paul Merrick, Gig Harbor, WA (US); Tommy R. Wyatt, Millers Creek, NC (US); Eric C. Billings, McGrady, NC (US); Brian W. Mathis, Traphill, NC (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 0 days.

(21) Appl. No.: 17/886,256

(22) Filed: Aug. 11, 2022

(65) Prior Publication Data

US 2023/0047169 A1 Feb. 16, 2023

Related U.S. Application Data

(60) Provisional application No. 63/233,311, filed on Aug. 15, 2021.

(51) Int. Cl.
*E04F 13/08* (2006.01)

(52) U.S. Cl.
CPC ..... *E04F 13/0894* (2013.01); *E04F 13/0871* (2013.01)

(58) Field of Classification Search
CPC ..... E04F 13/0894; E04F 13/0871; E04F 13/0803; E04F 13/0846; E04F 2201/02; E04F 13/07; E04F 13/0878
See application file for complete search history.

(56) References Cited

U.S. PATENT DOCUMENTS 2,799,058 A * 7/1957 Swenson ..... E04F 13/0846 24/336
3,187,389 A * 6/1965 Anderson ..... E04F 13/0846 52/489.1
3,274,743 A * 9/1966 Blum, Jr. ..... E04F 13/141 52/366
4,698,942 A 10/1987 Swartz
4,854,101 A 8/1989 Champagne
(Continued)

OTHER PUBLICATIONS

International Search Report and Written Opinion, PCT/US24/40104, Lousiana-Pacific Corp. (international filing date Aug. 11, 2022).

*Primary Examiner* — Gisele D Ford
(74) *Attorney, Agent, or Firm* — Wayne Edward Ramage; Baker Donelson

(57) ABSTRACT

A unique modified shiplap joint with a transverse spline extending into the respective edge of each piece of siding forming the joint. The spline ensures that the two adjacent pieces of siding are properly and adequately connected to each other, and, through the nail in the underlap portion of the joint, to the wall. The spline may be located in four possible positions: (1) attached to the back side of the underlap section of the joint (i.e., closest to the wall); (2) through the center of the underlap section of the joint; (3) directly attached to the front face of the underlap section of the joint; and (4) through the overlap section of the joint (i.e., closest to the outside face). The spline may be installed on one of the pieces of siding during manufacturing or at the factory, or alternatively, at the job site.

5 Claims, 6 Drawing Sheets

(56) References Cited

U.S. PATENT DOCUMENTS 4,995,215 A 2/1991 Menchetti
4,995,605 A 2/1991 Conville
5,544,461 A 8/1996 Sommerstein
5,564,245 A 10/1996 Rademacher
5,634,314 A 6/1997 Champagne
5,837,303 A 11/1998 Hayden
5,979,135 A 11/1999 Reeves
6,170,215 B1 1/2001 Nasi
6,402,419 B1 * 6/2002 Watanabe ..... E04F 13/0846 403/381
6,617,009 B1 * 9/2003 Chen ..... B29C 65/56 428/44
7,089,708 B1 * 8/2006 Bostock ..... E04F 13/0864 52/592.1
7,546,717 B2 6/2009 Complepark
7,621,092 B2 * 11/2009 Groeke ..... F16B 5/0056 52/582.1
8,336,272 B2 * 12/2012 Prager ..... F16B 5/0044 52/592.1
8,381,472 B1 2/2013 Fleenor
8,795,813 B2 8/2014 Olvey
9,080,320 B1 7/2015 Taylor
9,080,329 B2 * 7/2015 Dohring ..... E04F 13/0894
2002/0046546 A1 * 4/2002 Ito ..... E04F 13/0889 52/802.11
2002/0050111 A1 * 5/2002 Hikai ..... E04F 13/0846 52/302.3
2004/0211143 A1 * 10/2004 Hanning ..... F16B 5/0056 52/591.1
2004/0231252 A1 11/2004 Putti et al.
2004/0261348 A1 * 12/2004 Vulin ..... E04F 13/18 52/582.1
2007/0261353 A1 11/2007 Cullen
2008/0008433 A1 * 1/2008 Parker ..... E04F 13/0803 385/128
2010/0242398 A1 * 9/2010 Cullen ..... B32B 9/002 52/311.1
2012/0141830 A1 * 6/2012 Amar ..... E04C 2/46 428/688
2012/0241574 A1 * 9/2012 Uota ..... E04F 13/0846 248/231.81
2012/0317909 A1 * 12/2012 MacKenzie ..... E04F 13/0803 52/698
2016/0289956 A1 * 10/2016 Zhang ..... E04F 13/15
2016/0326749 A1 * 11/2016 Johnson ..... E04F 13/0846
2022/0136255 A1 * 5/2022 Sawada ..... E04F 13/0826 52/489.1

* cited by examiner

Underlap Embedded Spline - Axon

Underlap Embedded Spline - Detail A

Underlap Embedded Spline - Section
12" = 1'-0"

Face Mounted Spline- Axon

Face Mounted Spline - Detail A

Face Mounted Spline - Section
12" = 1'-0"

FLAT SIDING PRODUCT WITH LOCKING SPLINE

This application claims benefit of and priority to U.S. Provisional Application No. 63/233,311, filed Aug. 15, 2021, which is incorporated herein in its entirety by specific reference for all purposes.

FIELD OF INVENTION

This invention relates to a flat siding product with a unique locking spline attachment.

BACKGROUND OF INVENTION

Flat siding is an exterior cladding product that may be installed in horizontal, vertical or diagonal orientations. It may be installed fully flush with the wall, or attached to furring strips, such as those used in rain screen applications. It may come in various dimensions (e.g., ½" thick×8" wide×16' long), with various surface textures (e.g., smooth, cedar, and the like). It may be fashioned of various materials, including, but not limited to, sawn wood, engineered wood composites of various types, cellulose fiber cement, or combinations thereof.

Installation of flat siding products present a unique challenge when the aesthetic desire for a "blind nail" attachment (i.e., the nail head is not visible and does not penetrate the outer surface of the siding) is coupled with the engineering need to comply with applicable building code requirements for withstanding specified wind loads, so that adjacent pieces remain fully flush on the wall and resist being pulled away or detached from the wall. A modified form of a tongue-and-groove joint has the potential to solve this problem, but the siding thickness must be increased to allow for the machining of the joint. This is problematic from a cost, weight, and fastener capacity viewpoint. Furthermore, typical tongue-and-groove joints are not deep or rigid enough to withstand the forces developed under high wind loads.

Accordingly, what is needed is an improved siding system that uses a "blind nail" attachment while simultaneously provides for siding pieces of normal thickness to remain fully flush on, and resist being pulled away from, a wall.

SUMMARY OF INVENTION

In various exemplary embodiments, the present invention comprises a unique modified shiplap joint with a transverse spline extending into the respective edge of each piece of siding forming the joint. The spline may be formed of any suitable material, including, but not limited to, plastic or polymers, such as, but not limited to, polyvinyl chloride (PVC), polypropylene, or high impact polystyrene (HIPS). It is preferable to use materials that can be easily or safely cut using typical wood-working construction tools. The spline ensures that the two adjacent pieces of siding are properly and adequately connected to each other, and, through the nail in the underlap portion of the joint, to the wall.

The spline may be located in four possible positions: (1) attached to the back side of the underlap section of the joint (i.e., closest to the wall); (2) through the center of the underlap section of the joint; (3) directly attached to the front face of the underlap section of the joint; and (4) through the overlap section of the joint (i.e., closest to the outside face).

Each spline location provides attributes suitable for various applications. For example, the first and second positions allow the spline to not be visible from the outside face through the joint itself, and also avoid the fastener penetrating the pieces of siding. The fourth position shows the spline, which may be a contrasting color to the siding and thus provide a visual accent to a viewer.

The exact position of the spline may vary depending on the thickness of the siding and optimization during the manufacturing process. In several embodiments, the spline extends for some, substantially all, or all of the length of the edge or end of the siding. One edge (or side) of the spline may be affixed, such as by friction fit or with adhesive, to a corresponding recess, slot or kerf in one of the siding edges during the manufacturing process (i.e., it is affixed in place prior to installation), with the other siding edge comprising a matching recess, slot configured to receive the other edge (or side) of the spline, which is secured therein by friction fit or adhesive. Alternatively, the spline may be separately provided at the job site, and respective edges/sides inserted into the corresponding recesses, slots or kerfs during installation.

DETAILED DESCRIPTION OF EXEMPLARY EMBODIMENTS

Figure 1A:
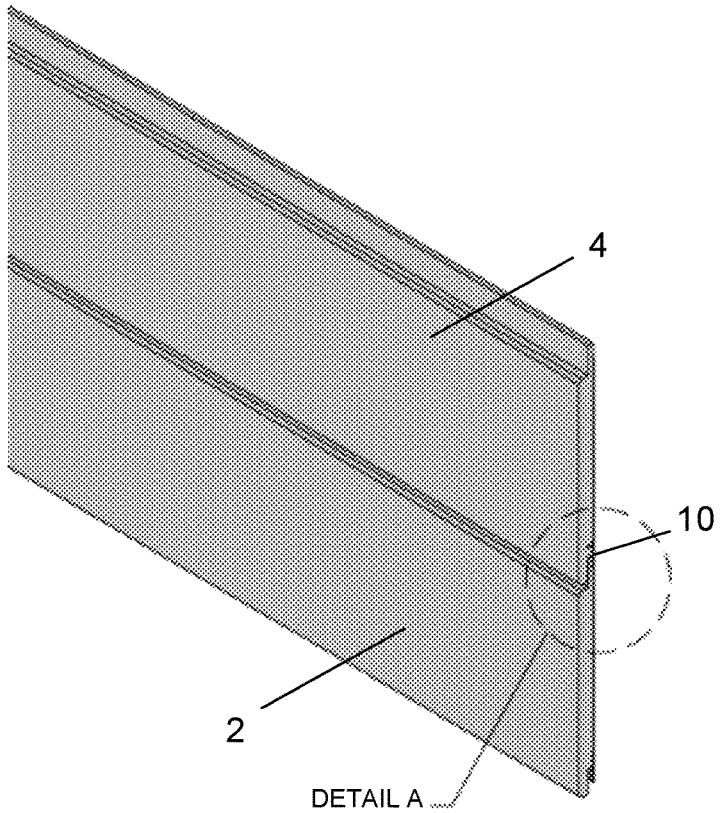
FIGS. 1A-C show perspective and cross-section views of a siding product with a backside flush-mounted in accordance with an embodiment of the present invention.
Figure 1B:
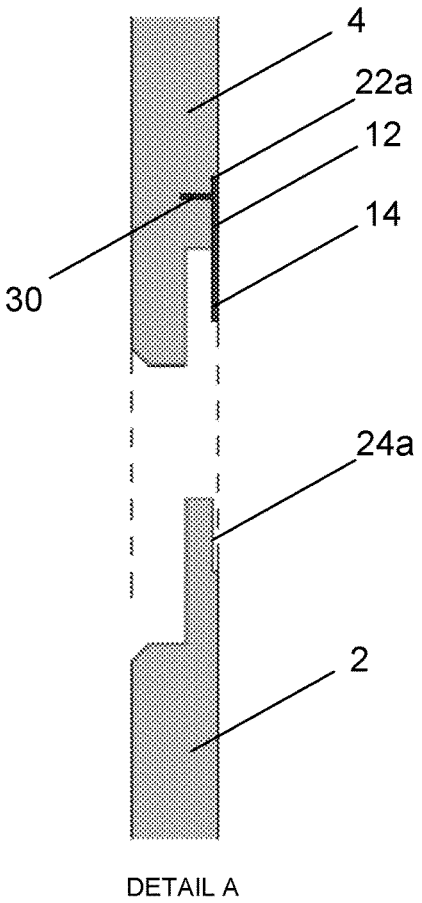
Figure 1C:
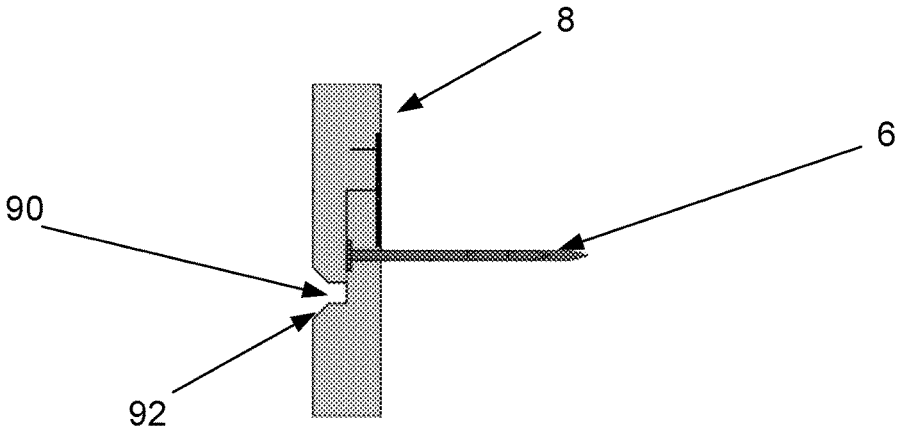
Figure 2A:
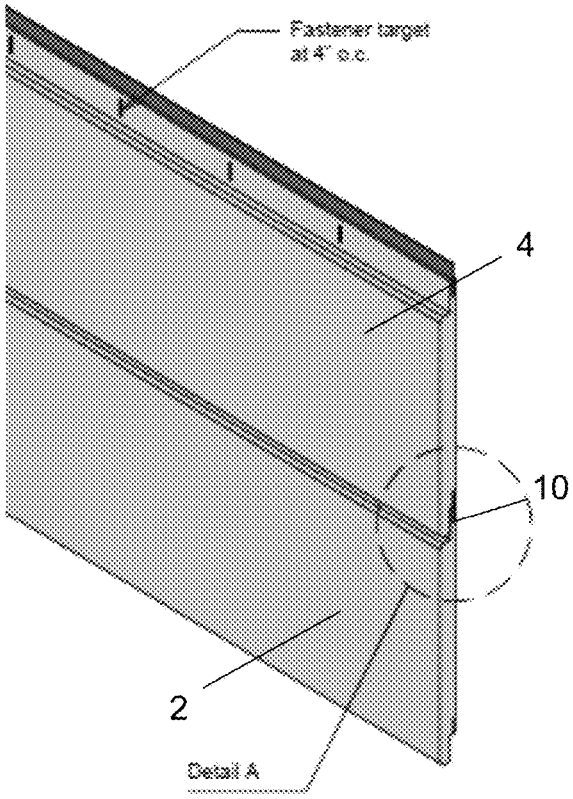
FIGS. 2A-C show perspective and cross-section views of an under-lap embedded (blind) spline in accordance with another embodiment of the present invention.
Figure 2B:
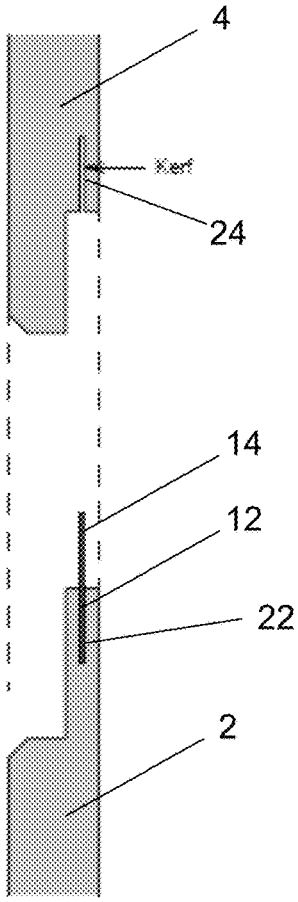
Figure 2C:
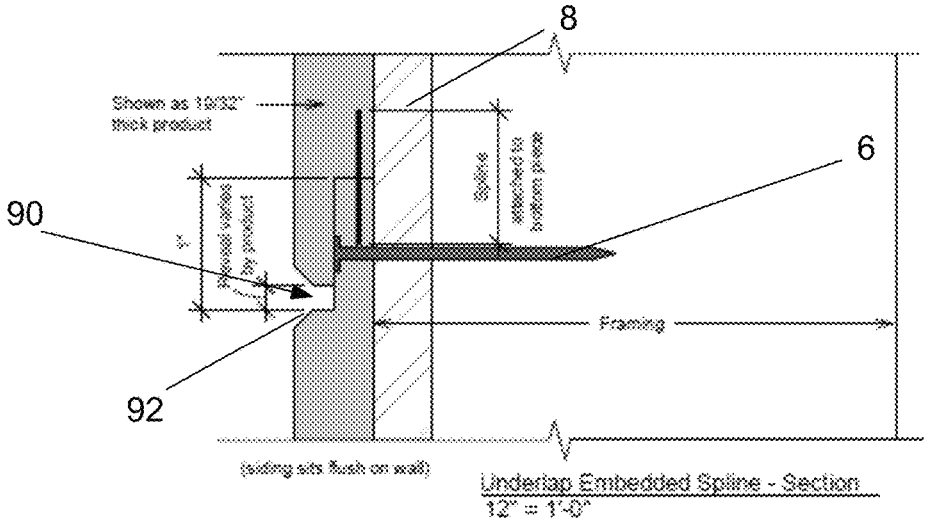

In various exemplary embodiments, the present invention comprises a unique modified shiplap joint with a transverse spline 10 extending into the respective edge of each piece of siding 2, 4. The spline may be formed of any suitable material, including, but not limited to, plastic or polymers, such as, but not limited to, polyvinyl chloride (PVC), polypropylene, or high impact polystyrene (HIPS). It is preferable to use materials that can be easily or safely cut using typical wood-working construction tools. The spline ensures that the two adjacent pieces of siding 2, 4 are properly and adequately connected to each other, and, through the nail (or other fastener) 6 in the underlap portion of the joint, to the wall 8 (and, potentially, framing).

As seen in the figures, the spline 10 preferably may be located in four possible positions: (1) attached to the back side of the underlap section of the joint (i.e., closest to the wall); (2) through the center of the underlap section of the joint; (3) directly attached to the front face of the underlap section of the joint; and (4) through the overlap section of the joint (i.e., closest to the outside face). Other positions in the joint sections are possible, depending on the exact configuration of the joint sections.

Each spline location provides attributes suitable for various applications. For example, the first and second locations shown in FIGS. 1A-C and 2A-C allow the spline to not be visible from the outside face through the joint itself, and also avoid the fastener penetrating the pieces of siding. The fourth position shows the spline, which may be a contrasting color to the siding and thus provide a visual accent to a viewer.

The position of the spline 10 may vary depending on the thickness of the siding and optimization during the manufacturing process. In several embodiments, the spline extends for some, substantially all, or all of the length of the edge or end of the siding. One edge (or side) 12 of the spline may be affixed, such as by friction fit or with adhesive, to a corresponding recess, slot or kerf 22 in one of the siding edges during the manufacturing process (i.e., it is affixed in place prior to installation), with the other siding edge comprising a matching recess, slot or kerf 24 configured to receive the other edge (or side) 14 of the spline 10, which is secured therein by friction fit, adhesive, or similar means. Alternatively, the spline may be separately provided at the job site, and respective edges/sides inserted into the corresponding recesses, slots or kerfs during installation. To improve a friction fit, barbs 40 may be placed on the section of spline to be inserted.

FIG. 1 shows a pre-fit spline 10 in the first position. One end (e.g., the upper end) 12 of the spline is affixed in a recess 22*a* on the back of the upper piece of siding 4, so that the spline 10 sits flush with the back face 4*a* of the siding. The spline may be stapled, fastened, glued, or adhered to the siding by means known in the art. In the figure, an integral post or rod or linear connector 30 extends from the face of the spline in contact with the back face of the siding, and is inserted into a groove, slot, hole or kerf 26 in the back face. It may be held there by friction fit, or it may have barbs 40 facing in the direction of the spline, so as to more securely hold the post, rod or linear connector 30. A second recess 24*a* on the back of the lower piece of siding (i.e., on the underlap) is configured to receive the bottom end of the spline so that it sits flush with the back face of the lower piece of siding.

The installation process for a pre-fit spline in the first position, as described above and illustrated in FIG. 1, proceeds as follows: (1) the lower piece of siding 2 is installed and fastened (such as by a nail 6) to the wall 8 with the underlap part of the joint facing up; (2) the upper piece of siding 4 with pre-attached spline 10 is placed above the lower piece and moved downward so the bottom edge of the spline 14 on the overlap part of the joint along the bottom edge of the upper piece 4 enters and engages the corresponding recessed area 24*a* machined into the back of the underlap part of the joint. As seen in the figures, the bottom part 14*a* of the spline ends above the fastener 6, and the fastener does not penetrate the spline. In this embodiment, the spline 10 also may be referred to as a flange or fin. A variation of this process may be used for vertically-aligned or diagonally-aligned siding.

The spline 10 thus positively locates and positions adjacent rows of siding, interlocking them and assisting in securely attaching the siding to the wall. This is especially valuable in high wind zones where additional face-penetrating nails or similar fasteners would be required absent the use of the present invention. An additional feature of the present invention is resistance to the penetration of moisture (e.g., wind-driven rain) and flames (e.g., an exterior wildfire event) through the joint, as the spline 10 serves as a barrier across the joint.

FIG. 2 shows an example of a spline 10 in the second position, where the spline is located in the underlap portion of a siding 2 top edge. In this embodiment, the underlap edge has a slot or kerf 22 into which the spline end 12 is embedded. The piece of siding 2 with the underlap is secured into place by nails 6 or similar fasteners, as described above (the nail or fastener can be placed as to not penetrate the spline). The bottom edge of the adjacent piece of siding 4, applied from above, has a receiving slot or kerf 24 located and sized to accept the upper end 14 of the spline.

The spline 10 may be affixed to the underlap prior to installation (i.e., factory-installed), such as by adhesive or staples. The spline also may be held in the underlap and/or overlap slot or kerf by friction-fit or the use of barbs, as described above. The underlap edge 12 of the spline 10 may be located a set distance away from the inside corner of the underlap (i.e., indexed), so that the underlap edge of the spline does not extend beyond the forward edge of the overlap section of the joint on the matching piece of siding. This permits the nail to be located so as not to be seen from the outer surface side. Thus, the spline itself also cannot be seen from the outer surface side once installed (i.e., a blind installation).

Figure 3A:
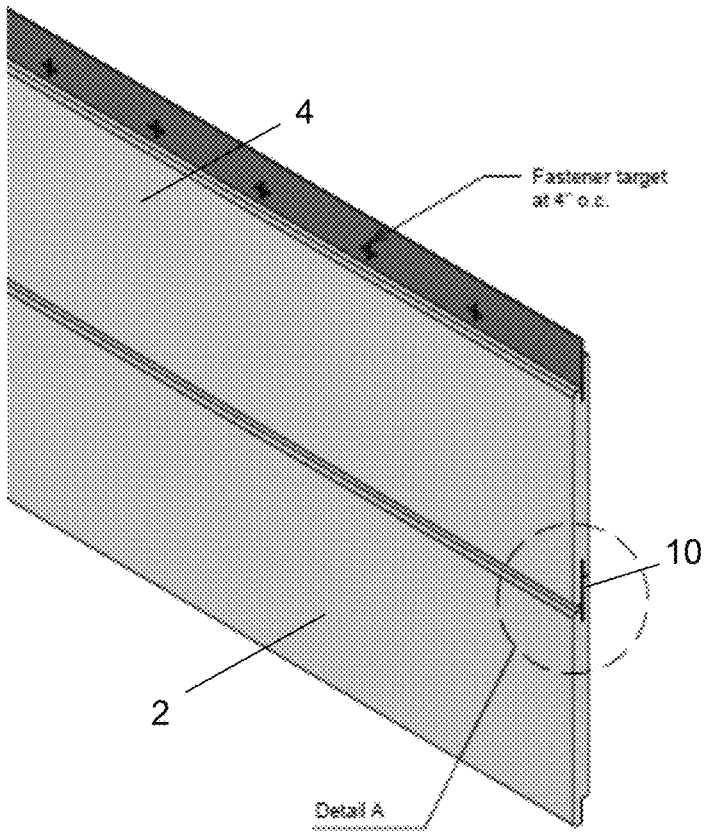
FIGS. 3A-C show perspective and cross-section views of a face-mounted spline in accordance with another embodiment of the present invention.
Figure 3B:
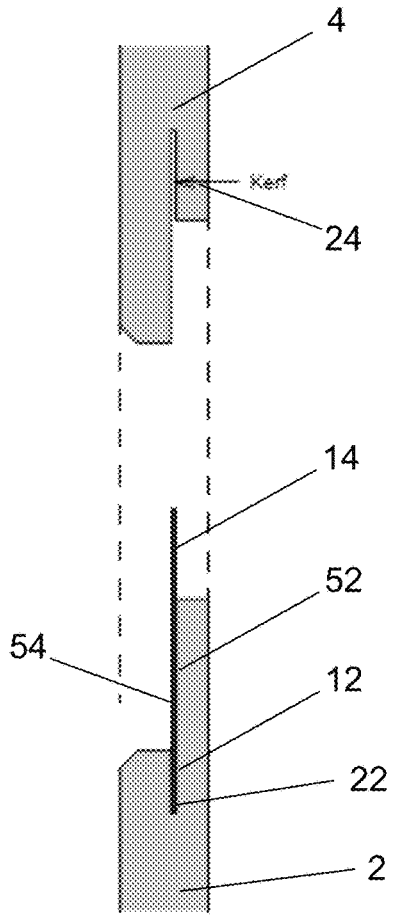
Figure 3C:
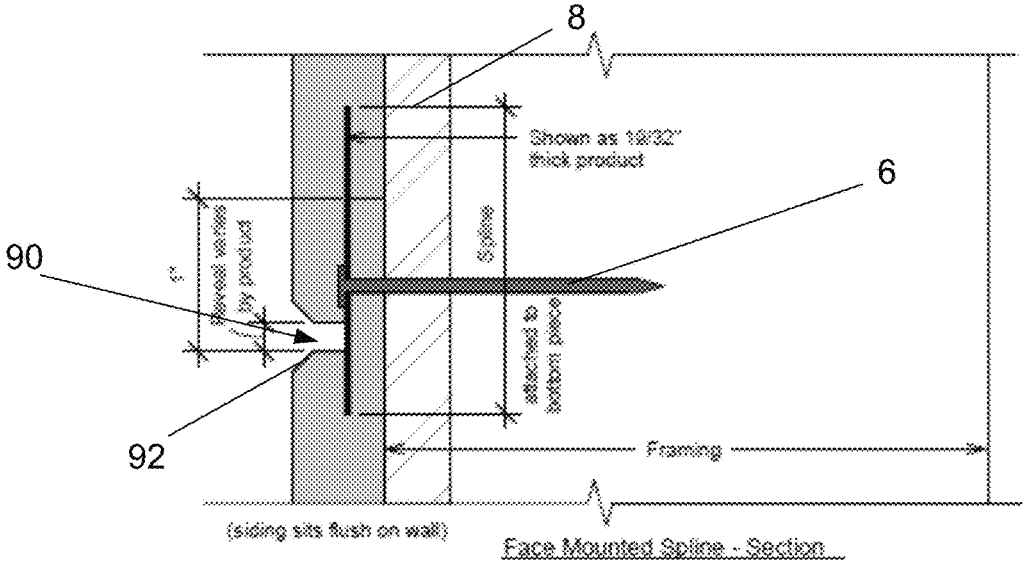

FIG. 3 shows the third position where the spline 10 is located on the front face 52 of the underlap at the top edge of the siding 2. Spaces, slots, or kerfs 22 adjacent located immediately adjacent to the front face of the underlap receive the corresponding edges of the spline 12. The spline also may be affixed to the underlap face 52 in the lower piece of siding 2 prior to installation and/or during the manufacturing or post-manufacturing process, such as by adhesive, nails, staples, or other fasteners. The lower edge 12 of the spline 10 is designed to fit into the slot or kerf 22 in the lower piece 2 during manufacture or during installation. During installation, after the lower piece 2 of siding is fastened into place, the top piece 4 is positioned above and slid into place such that the spline end 14 below is seated into the slot or kerf 24 located in the upper piece 4 of siding. A nail line or nailing targets/points 54 may be pre-printed on the spline, and a nail or similar fastener 6 is driven through the spline 10 and underlap to secure the respective piece of siding to the wall 8 prior to sliding the top piece into place. Part of the spline 10 may be visible from the outside face of the siding once installed.

Figure 4A:
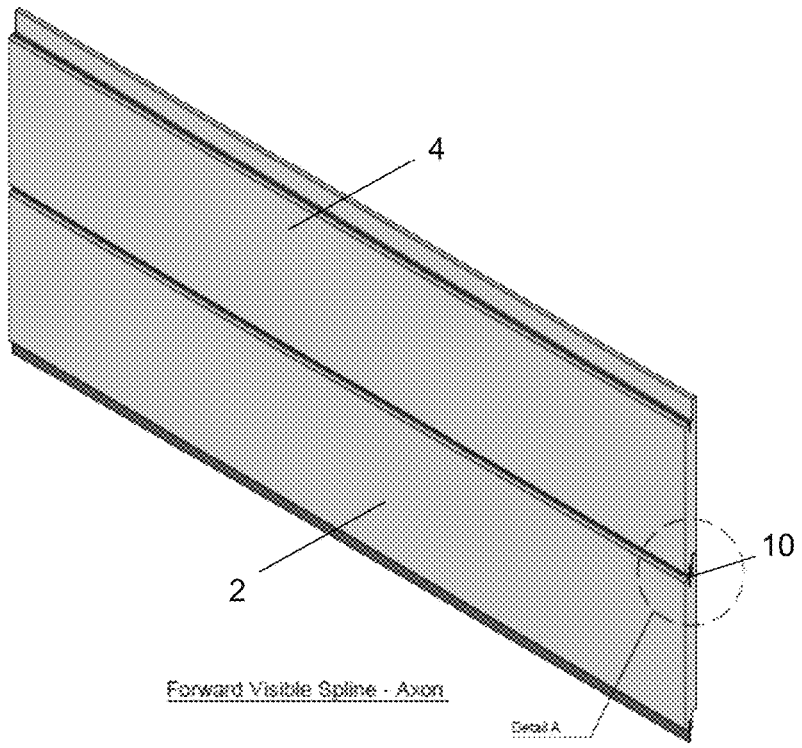
FIGS. 4A-C show perspective and cross-section views of a forward visible spline in accordance with another embodiment of the present invention.
Figure 4B:
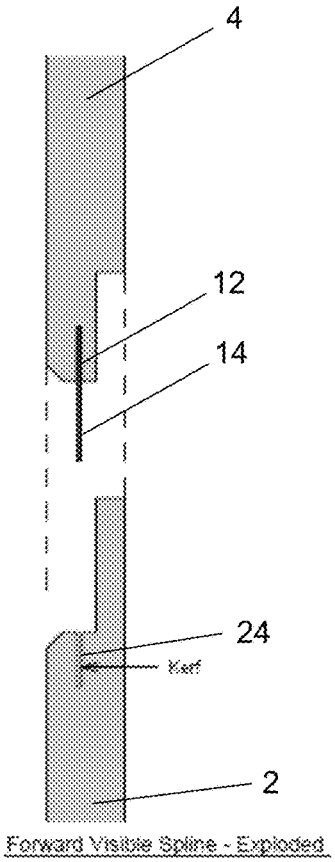
Figure 4C:
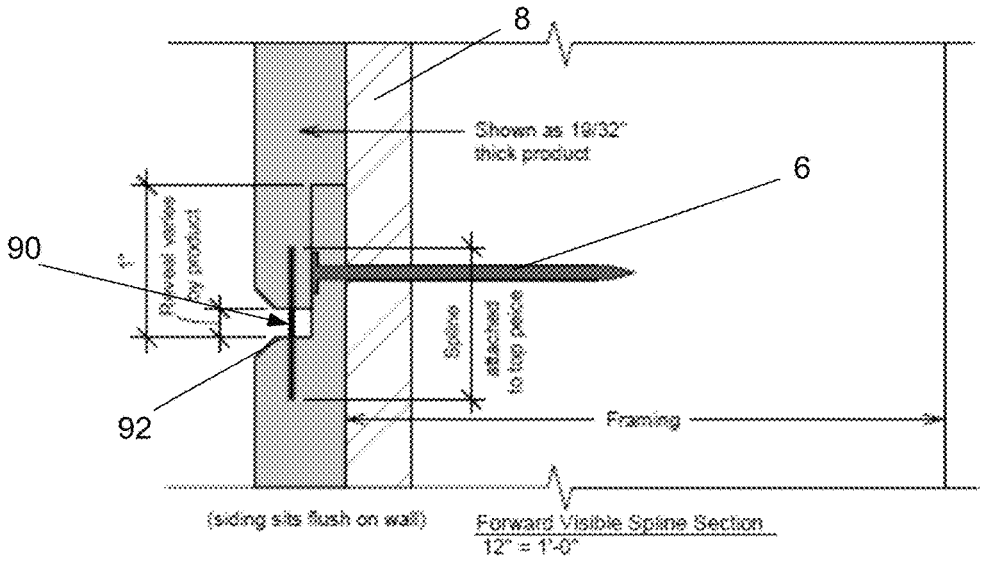
Figure 5B:
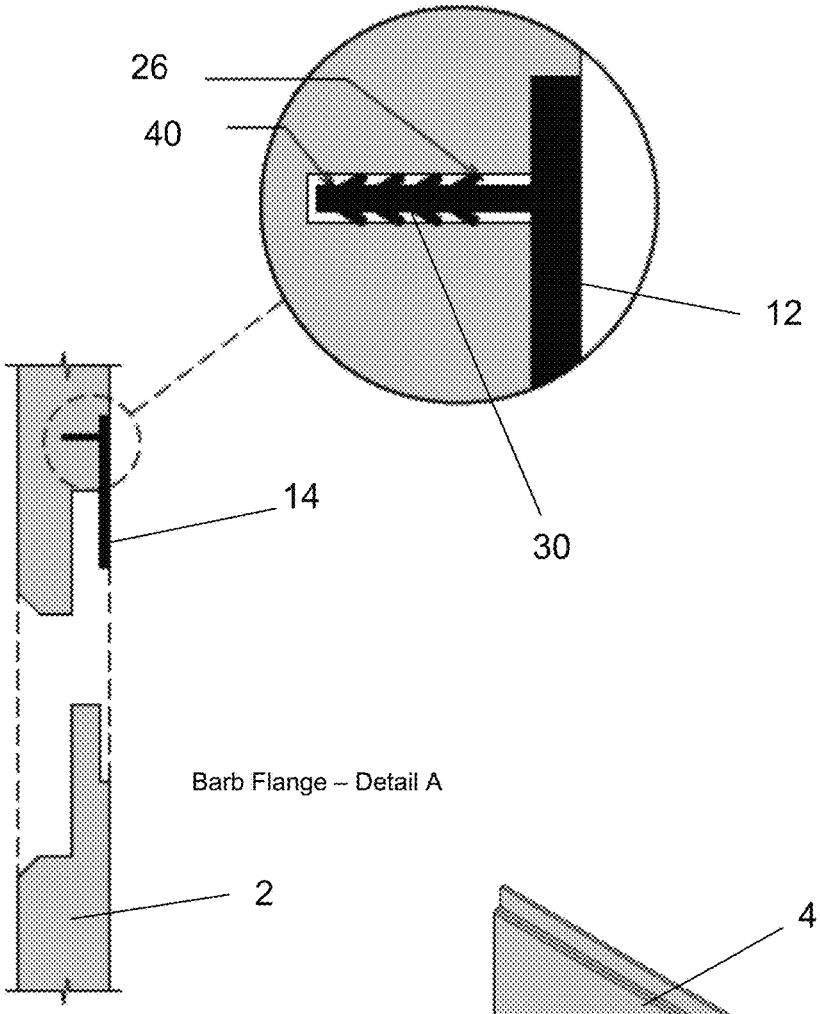
FIGS. 5A-C show perspective and cross-section views of a barbed spline insertion.
Figure 5A:
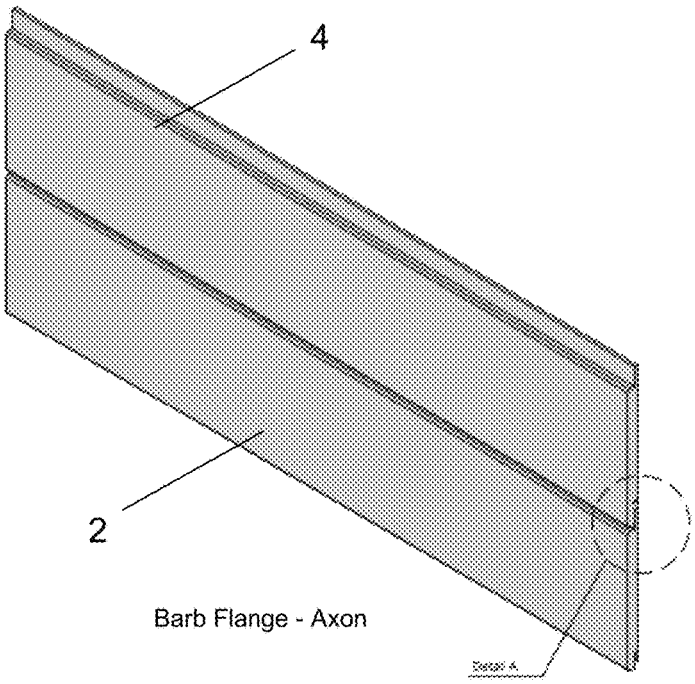
Figure 5C:
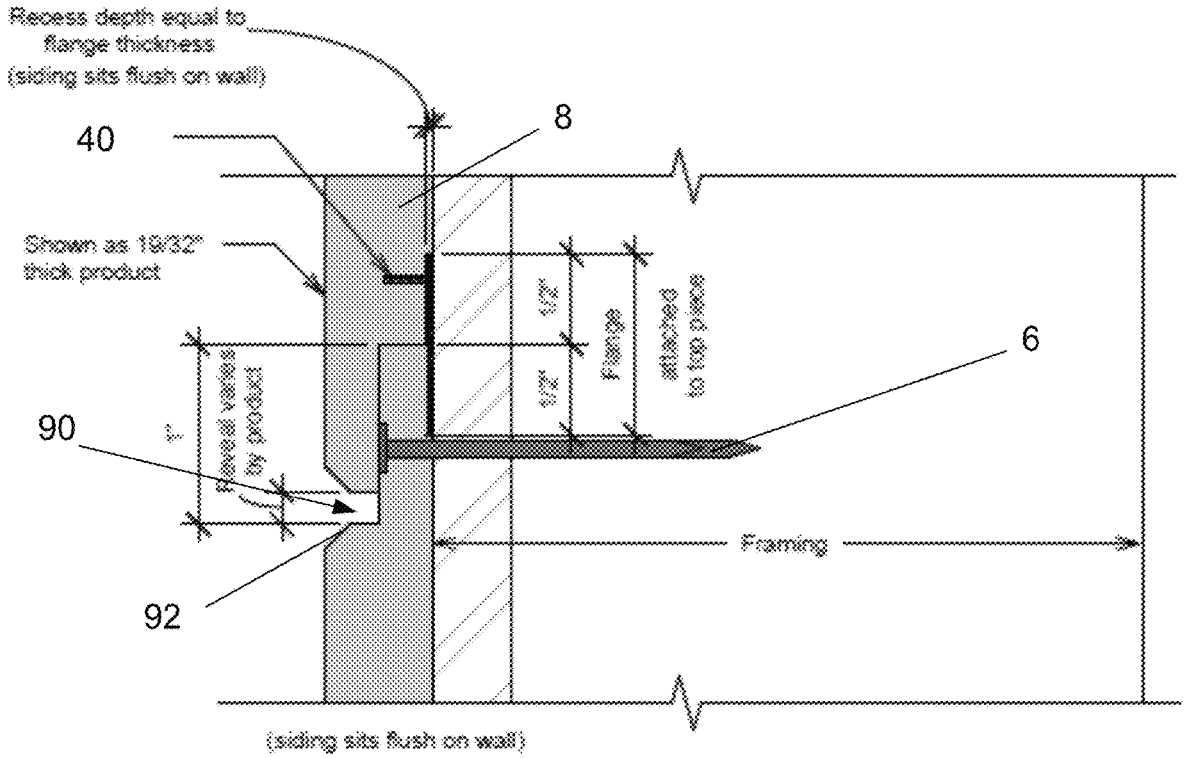

FIG. 4 illustrates the fourth position of the present invention. In this example, the spline 10 is located forward of the previous embodiments and is potentially visible from the outside face of the siding once installed. The spline 10 may be installed during installation, using, for example, a friction fit or barbs as described above, into the provided slots or kerfs 22, 24. The spline also may be pre-installed into the overlap of the siding 4 during the siding manufacturing process using friction fit, adhesive or the like. Installation of siding made using this embodiment starts with fastening the lower piece of siding 2 through the underlap (thus no nail penetrates the spline), followed by sliding the upper piece of siding 4 downward so that the spline end 14 of the upper piece of siding is inserted into the slot or kerf 24 of the lower piece of siding.

In several embodiments, the joint elements are self-indexing, so that when properly assembled a gap 90 of desired width is visible on the outer surface of the assembled pieces of siding at the joint (i.e., between adjacent pieces). In various embodiments, the joint edges on the outer faces of each piece of siding at the gap are beveled or rounded 92. This creates an unusual or smoother visual appearance of the siding when installed. The angle of the beveling may be at any appropriate angle (e.g., 5 to 85 degrees), depending on the facial appearance or treatment of the siding. In one exemplary embodiment, the beveling is between 30 to 60 degrees with respect to the outer face.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. An improved flat siding system, comprising:

a first piece of siding with a length, a front face, a back face, a first edge and a second edge, wherein the first edge comprises an overlap section of a modified shiplap joint, and the second edge comprises an underlap section of the modified shiplap joint, wherein the first edge overlap section is configured to mate with a corresponding underlap section of an adjacent piece of siding to form the modified shiplap joint, and the second edge underlap section is configured to mate with a corresponding overlap section of another adjacent piece of siding to form another modified shiplap joint;

a flat, rectilinear spline with a first spline edge and a second spline edge, said spline attached to the back face of first piece of siding adjacent to the first edge and extending for at least a portion of the length of the first piece of siding proximate to the first edge, wherein the first spline edge is disposed in a first recess located in the back face proximate to the first and extends into the first edge overlap section, wherein the spline does not extend beyond either the front face and the back face; and a second recess extending for at least a portion of the length of the first piece of siding on or proximate to the second edge of the first piece of siding opposite the first edge, and configured to receive the corresponding second spline edge inserted therein;

wherein no part of the spline is visible from the front of the modified shiplap joint when formed.

2. The system of claim 1, wherein the overlap section and the underlap section are self-indexing to produce a visible gap on the front of the modified shiplap joint when formed.

3. The system of claim 1, wherein the first recess and the second recess have a depth equal to a thickness of the linear spline.

4. The system of claim 1, wherein the overlap section and the corresponding underlap section overlap so that nothing on the back face or adjacent thereto is visible from the front of the modified shiplap joint when formed.

5. The system of claim 1, wherein the joint edges on the front faces are beveled or rounded.

* * * * *